United States Patent [19]

Lee

[11] 4,142,668

[45] Mar. 6, 1979

[54] SERUM-PLASMA SEPARATOR AND TRANSFER APPARATUS

[76] Inventor: Jae Y. Lee, 1122 Sunny Hill Dr., Columbus, Ohio 43221

[21] Appl. No.: 728,849

[22] Filed: Oct. 1, 1976

[51] Int. Cl.[2] ..... B04B 15/08

[52] U.S. Cl. ..... 233/1 R; 23/230 B; 128/2 F; 128/272; 210/131; 210/514; 210/516; 422/100; 422/101

[58] Field of Search ..... 210/83, 84, 131, 514–518, 210/DIG. 23, DIG. 24, 359; 23/258.5, 259, 230 B, 292; 128/214 R, 272, 2 F; 233/1 A, 1 R, 26

[56] References Cited

U.S. PATENT DOCUMENTS

| | | | |
|---|---|---|---|
| 3,355,098 | 11/1967 | Farr | 210/DIG. 23 |
| 3,392,834 | 7/1968 | Christensen | 210/DIG. 23 |
| 3,465,957 | 9/1969 | Brandt | 233/26 |
| 3,468,474 | 9/1969 | Shoblom et al. | 233/26 |
| 3,481,477 | 12/1969 | Farr | 210/DIG. 23 |
| 3,586,064 | 6/1971 | Brown et al. | 210/DIG. 24 |
| 3,630,191 | 12/1971 | Gifford | 210/DIG. 24 |
| 3,661,265 | 5/1972 | Greenspan | 210/DIG. 23 |
| 3,761,408 | 9/1973 | Lee | 210/DIG. 23 |
| 3,799,342 | 3/1974 | Greenspan | 210/DIG. 23 |

*Primary Examiner*—Frank W. Lutter
*Assistant Examiner*—Frank Sever
*Attorney, Agent, or Firm*—Cennamo, Kremblas & Foster

[57] ABSTRACT

Serum-Plasma separator and transfer apparatus comprising a tube and a hollow stopper-like member fitted into the open end of the tube. The top end of the stopper is of a flexible material with a weight positioned thereon. A rigid capillary tube with one end in the hollow stopper and the other end joined with a flexible capillary tube which, in turn, has its other end attached to a weighted filter. The capillary tube has a port in its side wall at the lower end adjacent the filter. As the serum is centrifuged the weighted filter drops into the tube causing the sample liquid to pass through the filter into the upper portion of the tube. At the same time the weight of the filter forces the flexible capillary tube to extend downwardly thereby opening the port in the capillary tube into the liquid sample. As the centrifuging action slows down, the weight on the stopper tend to return to its normal position. In this way a sucking action forces the liquid through the port into the capillary tube and then into the hollow stopper. The serum is then transferred without exposure.

10 Claims, 8 Drawing Figures

SERUM-PLASMA SEPARATOR AND TRANSFER APPARATUS

BACKGROUND AND PRIOR ART

Serum or plasma for use in clinical chemistry analysis is usually prepared by drawing whole blood from a patient into vacuumed tubes. The liquid is permitted to stand for a period of time to allow a clot to form. The sample is next centrifuged to separate the liquid from the solid particles. The serum or plasma is thereafter transferred into another container.

It is essential to obtain fibrin-free serum without unnecessary delay in that certain serum constituents may be changed by hemolysis, delayed separation and other factors.

Serum separating procedures utilized in the laboratory is a primary source of frequent contact of personnel to infectious diseases by either direct contact with the serum and/or by aerosol eminating from uncapped tubes while they are spinning.

Many devices and apparatus have been developed to improve and aid the serum separation. These include conventional squeezing method, barrier formation using beads, semi-permeable disks and semi-solid polymer, transfer of serum into a plastic container by passage through a hole or tube in a rubber or flexible plastic disk, and finally to the sealed container of polymer that is placed on the top of the blood-collecting tube just before centrifugation. The semi-solid polymer falls from the container through the serum and forms a barrier between the serum and the clot. More recent devices also include the vacuum tube having the polymer within the tubes, wherein the polymer falls and forms a barrier between the two phases during centrifugation. These devices aid the separation of the serum but not the transfer of the serum or plasma into other containers.

Although it is the primary purpose of the prior art devices to obtain fibrin-free sample, it has been found that small particles of the polymer floating on the surface of the serum may cause even a more serious clogging problem than fibrin for the automated instrument.

OBJECTS

It is a primary object of the present invention to provide a serum-plasma separator tube that does not require the additional step of transferring the serum or plasma into another container; has a built-in filtering system to provide fibrin-free sample; and is air tight to prevent aerosols escaping into the room.

Other objects and features of the present invention will become apparent from the following detailed description when taken in conjunction with the drawings in which:

DETAILED DESCRIPTION OF DRAWINGS

Figure 1B:
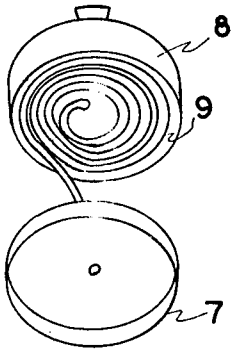
FIG. 1B is a perspective view of the folded capillary tube of FIG. 1.
Figure 1:
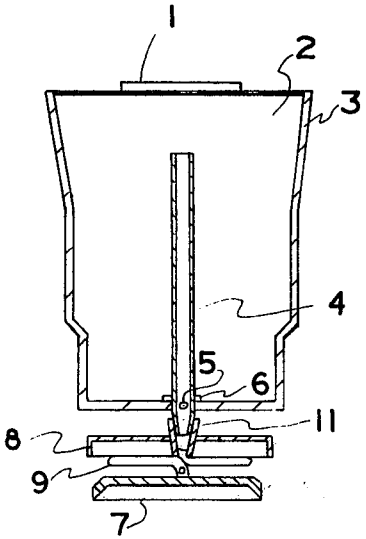
FIG. 1 is a cross-sectional view of the hollow like stopper of the present invention.
Figure 1A:
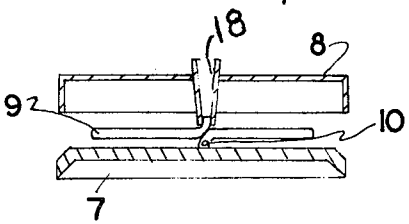
FIG. 1A is an exploded cross-sectional view of the flexible capillary tube of FIG. 1.

With particular reference to FIGS. 1, 1A, and 1B there is illustrated in its preferred embodiment the apparatus of the present invention. Hollow-like stopper 3 is in fact a container capable of receiving and holding a liquid. Its lower portion 3*a* is adapted to sealingly engage the inner wall of a conventional laboratory test tube — thereby acting as a stopper. The wall of stopper 3 may be of the conventional rubber-like material. The upper end 2 of the stopper 3 is of a thin highly flexible material. Centrally and fixedly positioned on this upper portion is a weight 1. It can be seen that as a vertical movement is imparted to the over all structure of the stopper 3 the top portion 2 will flex due to the weight 1 thereon.

At the lower end of the hollow-like stopper 3 is an aperture 3*b* positioned in the aperture, and in sealing engagement therewith, is the capillary tube 4. The upper end 4*a* of capillary tube 4 extends approximately two/thirds into the hollow are of stopper 3.

The capillary tube 4 extending through the aperture 3*a* engages, immediately adjacent thereto, a first collar/separator 8 — more fully described hereinafter. The flexible capillary tube 9 below the collar 8 is wound into a spring-like coil with the extreme end thereof connected to a second collar/separator that is in this instance a filter 7. The weight of filter 7 is sufficient to extend the spring-like capillary tube upon the appropriate motion being imparted thereto.

In the side wall of the capillary tube 9 connected to the filter 7 is a first port 10 sufficient in size to withdraw the liquid from a test tube. A second port 5 is positioned in the capillary tube 4 to exactly coincide with the inner walls of the aperture 3*a* in the stopper 3. Stop 6 prevents the tube 4A from leaving the container 3.

Figure 2B:
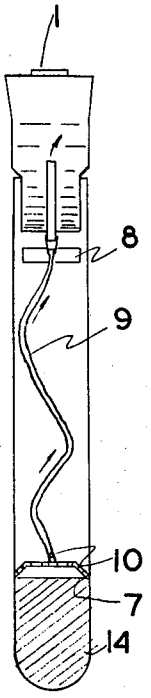
FIG. 2B illustrates the position of the elements and sample after centrifugation.
Figure 2A:
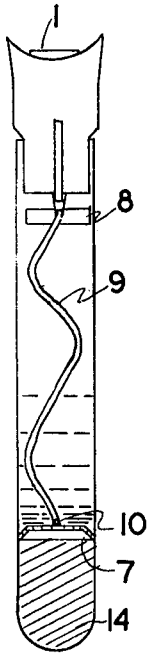
FIG. 2A illustrates the position of the elements, and sample when at maximum speed of centrifuge.
Figure 2:
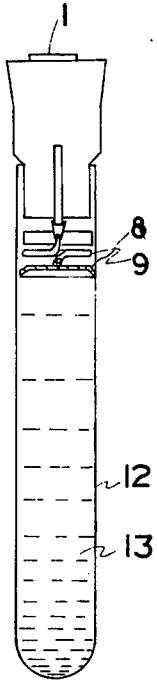
FIG. 2 is the stopper of FIG. 1, together with a sample tube.

With reference to FIGS. 2, 2A and 2B the operation of the apparatus of the present invention may now be described. The tube 12 has therein a blood sample 13 that has stood for a given period of time to clot. The container 3 of FIG. 1 together with its associated apparatus is placed in the open end of the tube 12 and hence acts as a stopper.

The entire assembly of FIG. 2 is placed in a conventional centrifuging machine to separate the serum from the cells. As the speed increases and due to the centrifugal forces the filter 7 drops to the lower portion of the tube 12. As this happens the serum 15 is filtered through the filter and passes into the upper portion of the tube 12; whereas the clotted liquid 14 together with solid particles remain in the lower portion of the tube 12. The filter 7 quite obviously passes only the liquid and not the fibrous material.

Also as the filter drops to the lower end of the tube, the spring-like capillary tube 9 is extended downwardly. Again as the centrifugal forces are at maximum the weight 1 on top 2 of stopper 3 fully flexes downwardly, i.e. depresses downwardly the flexible upper portion of the stopper 3. As the speed of the centrifugal action decreases, thereby decreasing the centrifugal forces, the weight 1 will tend to return to its normal position with the flexible upper portion of the container.

As this occurs a sucking action causes the liquid serum 15 to be sucked up through the port 10 in the capillary tube 9 into the capillary tube 4, and then expelled into the container 3.

Referring again to FIGS. 1 and 1A the collar 8 has centrally positioned therein a frusto-conical shaped aperture 18. The capillary tube 4, being a rigid structure, has its lower end in sealing engagement with the upper end of the aperture 18. The spring-like capillary tube 9 has its upper end fixedly engaging the lower end of the aperture 18.

Figure 3A:
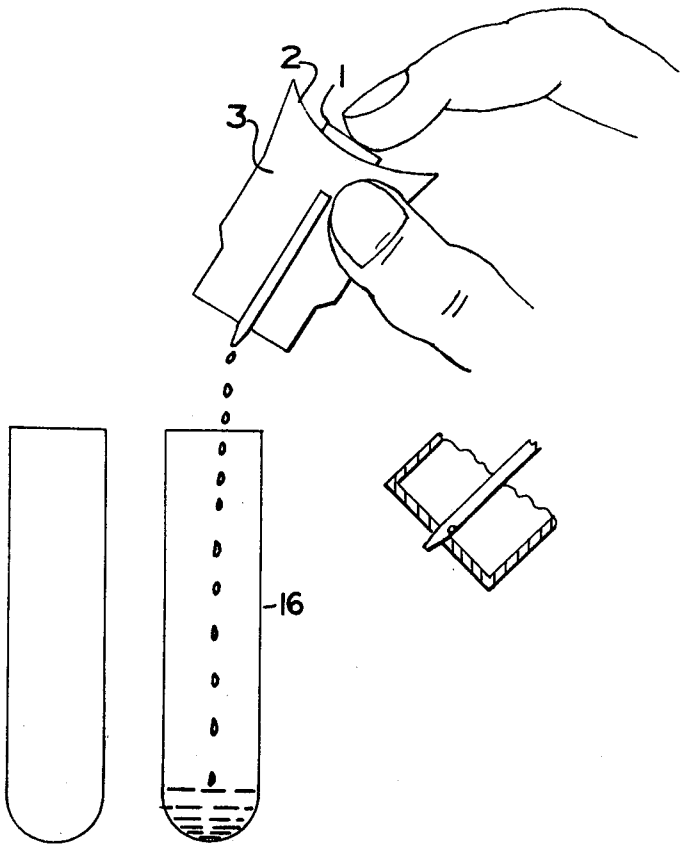
FIG. 3A illustrates the manner of transfer of the liquid sample to another tube.
Figure 3:
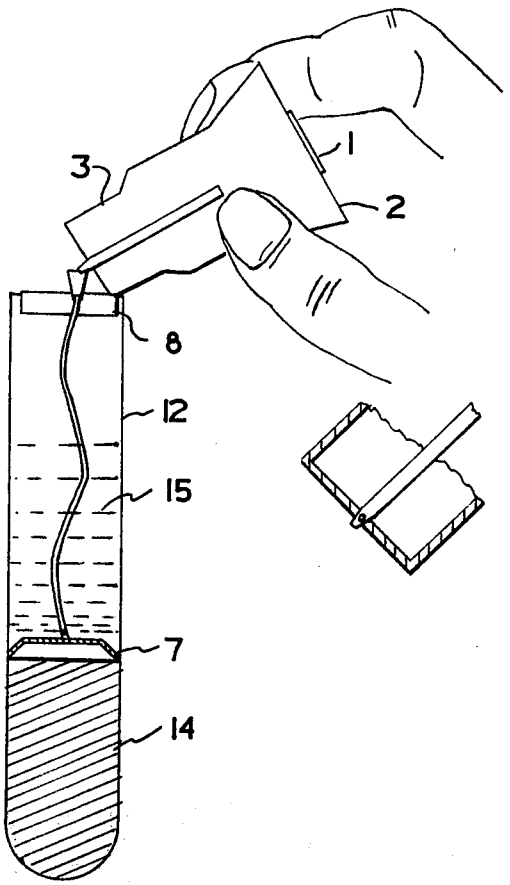
FIG. 3 illustrates the manner of removal of the filled hollow-like stopper from the tube.

Referring now to FIGS. 3 and 3A together with FIGS. 1 and 1A it is seen that to remove the container 3 — having the centrifuged liquid 15 therein — from the tube 12, the container 3 is physically bended thereby disengaging the lower end of capillary tube 4*a* from the frusto-conical aperture 18 of collar 8.

To expel the liquid sample 15 from the container 3 into another test tube — with a minimum of exposure to the atmosphere, the tip of capillary tube 4 is pushed upwardly. The second port 6 is thusly opened. When the weight on the flexible upper portion 2 is pressed downwardly the sample liquid 15 is forced to leave the container 3.

Although, only certain and specific embodiments illustrated and described it is to be appreciated that modifications may be had without departing from the true spirit and scope of the invention.

What is claimed:

1. A Serum-Plasma centrifugal separator tube with transfer apparatus and means for centrifuging said tube apparatus comprising a:

container having its lower end recessed and adapted to sealing fit into the open end of a test tube, the upper top portion of said container comprised of a thin-flexible material and having a weight centrally positioned thereon, and the lower most portion of the container having an aperture therein;

a capillary tube extending into a substantial portion of said container and its other end extending through said aperture in said container;

an extendable capillary tube having its extreme end connected to a filter; and means for joining said extendable capillary tube with said first named capillary tube;

a port positioned in said extendable capillary tube adjacent said extreme end connected to said filter;

said extendable capillary tube contracted adjacent said joining means and extended together with said filter when a liquid sample is centrifuged thereby separating the liquid from other particulates, and said weight depressing said flexible top portion of said container also when a liquid sample is centrifuged; and when the centrifuge action decreases said depressed flexible top returns to its normal position to suck said liquid through said capillary tube into said container.

2. The container of claim 1 wherein said means for joining said two mentioned capillary tubes is a collar further having means for maintaining said first capillary tube in a press fit and fixedly maintaining said extendable capillary tube.

3. The container of claim 2 wherein said collar means for maintaining said capillary tubes includes a frusto-conical aperture.

4. The container of claim 1 wherein said capillary tube extending through the aperture in the lowermost portion of said container has a port positioned therein adjacent said aperture.

5. The container of claim 4 wherein said container together with said capillary tube is removed from said test tube and collar by physically disengaging said capillary tube from said frusto-conical aperture in said collar.

6. The container of claim 1 further comprising means to limit the travel of said capillary tube when engaged by said depressed upper portion.

7. The container of claim 6 wherein the liquid in said container is removed by depressing said flexible upper portion of said container to engage said capillary tube and thereby expose said last named port.

8. The container of claim 1 wherein said contracted extendable capillary tube comprises a near-planar coiled tube.

9. The container of claim 8 wherein said coiled tube is a spring-like coil; a collar, and wherein said coil is positioned in said collar.

10. The container of claim 9 wherein the weight of said filter is sufficient to extend said extendable spring-like coil when a liquid sample is centrifuged.

* * * * *